US007755571B2

(12) United States Patent
Han et al.

(10) Patent No.: US 7,755,571 B2
(45) Date of Patent: Jul. 13, 2010

(54) PLASMA DISPLAY APPARATUS

(75) Inventors: Jung Gwan Han, Kumi-si (KR); Seong Ho Kang, Daegu-si (KR)

(73) Assignee: LG Electronics Inc., Seoul (KR)

( * ) Notice: Subject to any disclaimer, the term of this patent is extended or adjusted under 35 U.S.C. 154(b) by 1237 days.

(21) Appl. No.: 11/314,820

(22) Filed: Dec. 22, 2005

(65) Prior Publication Data

US 2006/0139243 A1 Jun. 29, 2006

(30) Foreign Application Priority Data

Dec. 23, 2004 (KR) ..... 10-2004-0111508

(51) Int. Cl.
*G09G 3/28* (2006.01)

(52) U.S. Cl. ..... 345/60

(58) Field of Classification Search ..... 345/60; 313/582, 583

See application file for complete search history.

(56) References Cited

U.S. PATENT DOCUMENTS 5,636,262 A * 6/1997 Melian ..... 379/1.01
5,943,030 A * 8/1999 Minamibayashi ..... 345/60
6,078,205 A * 6/2000 Ohsawa et al. ..... 327/314
6,624,798 B1 * 9/2003 Aoki et al. ..... 345/60
6,646,387 B2 * 11/2003 Chae et al. ..... 315/165
6,703,702 B2 * 3/2004 Inoue et al. ..... 257/684

FOREIGN PATENT DOCUMENTS

EP 0 867 853 9/1998

OTHER PUBLICATIONS

European Search Report dated May 5, 2009.

* cited by examiner

*Primary Examiner*—Richard Hjerpe
*Assistant Examiner*—Tom V Sheng
(74) *Attorney, Agent, or Firm*—KED & Associates, LLP

(57) ABSTRACT

A plasma display apparatus is disclosed. The apparatus includes: a data driver for applying a data voltage to a plurality of address electrodes; and a connection unit connected between the address electrode and the data driver, and having a different resistance from the address electrode.

3 Claims, 7 Drawing Sheets

PLASMA DISPLAY APPARATUS

BACKGROUND OF THE INVENTION

1. Field of the Invention

The present invention relates to a plasma display apparatus, and more particularly, to a plasma display apparatus for preventing an inverse current from being introduced from a panel to a panel driver to reduce a heat dissipation of a data driving integrated circuit, thereby improving a driving reliability.

2. Description of the Background Art

Plasma display apparatus displays an image by exciting and emitting a phosphor using ultraviolet rays generated when an inert mixture gas is discharged. In the plasma display apparatus, thinning and large-sizing are not only easy but also a quality of picture is improved owing to a recent development of technology.

FIG. 1 illustrates a method for expressing the gray level in the plasma display apparatus. In order to embody the gray level of the image, the plasma display apparatus is time-division driven with one frame divided into several subfields having a different number of times of emission.

Each subfield is divided into a reset period for initializing a whole screen, an address period for selecting a scan line and selecting a discharge cell at the selected scan line, and a sustain period for embodying the gray level depending on the number of times of discharge.

For example, when the image is displayed at 256 gray levels, a frame period (16.67 ms) corresponding to 1/60 second is divided into eight subfields (SF1 to SF8) as in FIG. 1.

Each of the eight subfields (SF1 to SF8) is divided into the reset period, the address period, and the sustain period as described above.

The reset period and the address period of each subfield are the same at each subfield whereas the sustain period and the number of sustain pulses allocated to the sustain period are increased at a rate of $2^n$ (n=0, 1, 2, 3, 4, 5, 6, 7) at each subfield.

Accordingly, the plasma display apparatus accumulates brightness of each subfield, and displays the image at a desired gray level.

FIG. 2 schematically illustrates an electrode arrangement of a conventional three-electrode alternating current surface discharge type plasma display apparatus.

Referring to FIG. 2, the conventional three-electrode alternating current surface discharge type plasma display apparatus includes scan electrodes (Y1 to Yn) and a sustain electrode (Z) formed at an upper substrate, and address electrodes (X1 to Xm) formed at a lower substrate to intersect with the scan electrodes (Y1 to Yn) and the sustain electrode (Z).

Discharge cells 1 are arranged in matrix at intersections of the scan electrodes (Y1 to Yn), the sustain electrode (Z), and the address electrodes (X1 to Xm).

A dielectric layer and an MgO protective layer (not shown) are layered on the upper substrate where the scan electrodes (Y1 to Yn) and the sustain electrode (Z) are formed.

A barrier rib for preventing optical and electrical jamming between adjacent discharge cells 1 is formed on the lower substrate where the address electrodes (X1 to Xm) are formed.

The phosphor excited by the ultraviolet rays and emitting visible rays is formed at the lower substrate and a surface of the barrier rib.

The inert mixture gas, such as He+Xe, Ne+Xe, and He+Xe+Ne, is injected into a discharge space between the upper substrate and the lower substrate.

FIG. 3 illustrates a driving waveform applied to the conventional plasma display apparatus of FIG. 2.

Referring to FIG. 3, each of the subfields (SFn-1 and SFn) includes the reset period (RP) for initializing the discharge cells 1 of the whole screen, the address period (AP) for selecting the discharge cell, the sustain period (SP) for sustaining the discharge of the selected discharge cell 1, and an erasure period (EP) for erasing wall charges within the discharge cell 1.

In the erasure period (EP) of the (n-1)th sub field (SFn-1), an erasure ramp waveform (ERR) is applied to the sustain electrode (Z). During the erasure period (EP), 0V is applied to the scan electrode (Y) and the address electrode (X). The erasure ramp waveform (ERR) is a positive ramp waveform that gradually increases from OV to a positive sustain voltage (Vs). By the erasure ramp waveform (ERR), erasure discharge occurs between the scan electrode (Y) and the sustain electrode (Z) within on-cells where the sustain discharge occurs.

In a setup period (SU) of the reset period (RP) at which the nth subfield (SFn) initiates, a positive ramp waveform (PR) is applied to all the scan electrodes (Y), and 0V is applied to the sustain electrode (Z) and the address electrode (X).

By the positive ramp waveform (PR) of the setup period (SU), a voltage of the scan electrode (Y) gradually increases from a positive sustain voltage (Vs) to a reset voltage (Vr) higher than the positive sustain voltage.

By the positive ramp waveform (PR), a dark discharge not almost generating light is generated between the scan electrode (Y) and the address electrode (X) within the discharge cells of a whole screen, and at the same time, the dark discharge is generated even between the scan electrode (Y) and the sustain electrode (Z).

As a result of the dark discharge, soon after the setup period (SU), positive wall charges remain on the address electrode (X) and the sustain electrode (Z), and negative wall charges remain on the scan electrode (Y).

While the dark discharge is generated in the setup period (SU), a gap voltage (Vg) between the scan electrode (Y) and the sustain electrode (Z) and a gap voltage between the scan electrode (Y) and the address electrode (X) are initialized to a voltage close to a firing voltage (Vf) capable of generating the discharge.

Consequently to the setup period (SU), a negative ramp waveform (NR) is applied to the scan electrode (Y) in the setdown period (SD) of the reset period (RP).

At the same time, the positive sustain voltage (Vs) is applied to the sustain electrode (Z), and OV is applied to the address electrode (X).

By the negative ramp waveform (NR), the voltage of the scan electrode (Y) gradually decreases from the positive sustain voltage (Vs) to a negative erasure voltage (Ve).

By the negative ramp waveform (NR), the dark discharge is generated between the scan electrode (Y) and the address electrode (X) within the discharge cell of the whole screen and at the same time, the dark discharge is generated even between the scan electrode (Y) and the sustain electrode (Z).

As a result of the dark discharge of the setdown period (SD), a distribution of the wall charges within the respective discharge cells 1 is changed to addressable condition.

At this time, excessive wall charges unnecessary for an address discharge are erased from and a predetermine amount of wall charges remains on the scan electrode (Y) and the address electrode (X) within the respective discharge cells 1. While the negative wall charges are moved from the scan electrode (Y) and accumulated on the sustain electrode (Z), the wall charges on the sustain electrode (Z) are inverted from a positive polarity to a negative polarity. While the dark discharge is generated in the setdown period (SD) of the reset period (RP), a gap voltage between the scan electrode (Y) and the sustain electrode (Z) and a gap voltage between the scan electrode (Y) and the address electrode (X) gets close to the firing voltage (Vf).

In the address period (AP), a negative scan pulse (−SCNP) is sequentially applied to the scan electrode (Y) and at the same time, a positive data pulse (DP) is applied to the address electrode (X) in synchronization with the scan pulse (−SCNP). A voltage of the scan pulse (−SCNP) is a scan pulse (Vsc) decreasing from OV or the negative scan bias voltage (Vyb) close to OV to the negative scan voltage (−Vy). A voltage of the data pulse (DP) is the positive data voltage (Va).

During the address period (AP), the positive Z bias voltage (Vzb) lower than the positive sustain voltage (Vs) is supplied to the sustain electrode (Z). Soon after the reset period (RP), in a state where the gap voltage is adjusted to be close to the firing voltage (Vf), the gap voltage between the scan electrode (Y) and the address electrode (X) exceeds the firing voltage (Vf) within the on-cells to which the scan voltage (Vsc) and the data voltage (Va) are applied while generating a primary address discharge between the electrodes (X and Y).

The primary address discharge between the scan electrode (Y) and the address electrode (X) occurs near an edge distant from a gap between the scan electrode (Y) and the sustain electrode (Z). The primary address discharge generates priming charged particles within the discharge cell, and induces a second discharge between the scan electrode (Y) and the sustain electrode (Z).

Meantime, a distribution of wall charges within off-cells not generating the address discharge is substantially identical with the distribution of wall charges soon after the setdown period.

In the sustain period (SP), the sustain pulses (SUSP) of the positive sustain voltage (Vs) are alternately applied to the scan electrode (Y) and the sustain electrode (Z). If so, in the on-cells selected by the address discharge, the sustain discharge occurs between the scan electrode (Y) and the sustain electrode (Z) at each sustain pulse (SUSP).

On contrary, in the off-cells, the discharge does not occur during the sustain period. This is because, since the distribution of wall charges of the off-cells are substantially identical with the distribution of wall charges soon after the setdown period, when the positive sustain voltage (Vs) is initially applied, the gap voltage between the scan electrode (Y) and the sustain electrode (Z) cannot exceed the firing voltage (Vf).

However, the conventional plasma display apparatus has a drawback in that a data driving integrated circuit for supplying data to the address electrode dissipates a large amount of heat and frequently fails. This phenomenon results in the greatest high current introduced from the address electrode (X) to the data driving integrated circuit. This will be in detail described with reference to FIG. 4.

FIG. 4 is an equivalent circuit diagram illustrating conventional data driving integrated circuit and plasma display panel connected thereto.

Referring to FIG. 4, the data driving integrated circuit 40 includes a first switching element (S1) connected to a data voltage source (Va); and a second switching element (S2) connected to a base voltage source (GND). The data driving integrated circuit 40 includes an energy recovery circuit (not shown) for charging the address electrode (X) by a RC series circuit, and recovering reactive power not contributing to the discharge from the address electrode (X). In general, the data driving integrated circuit 40 is connected to the plurality of address electrodes (X) provided to the plasma display apparatus in the COF form.

In FIG. 4, "Rp" denotes a parasitic resistance of the address electrode (X) provided between the data driving integrated circuit and the panel capacitor (Cp), and the panel capacitor (Cp) denotes a parasitic capacitance between the address electrode (X) and the scan electrode (Y), and a parasitic capacitance between the address electrode (X) and the sustain electrode (Z).

During the address period, when data is at a high logic level, the first switching element (S1) turns on under the control of the timing controller and supplies a data voltage (Va) of more than about 80V to the address electrode (X) whereas, when the data is at a low logic level, turns off under the control of the timing controller. The first switching element (S1) maintains an off state during a period besides the address period.

During the address period, when the data is at the low logic level, the second switching element (S2) turns on under the control of the timing controller and supplies the base voltage (GND) to the address electrode (X) whereas, when the data is at the high logic level, turns off under the control of the timing controller. The second switching element (S2) maintains an on state during a period besides the address period.

The data driving integrated circuit 40 has a drawback of dissipating the heat by the inverse current introduced from the panel capacitor (Cp) via the parasitic resistance (Rp) and capable of being damaged due to dielectric breakdown, which is caused by the inverse current, of switching elements embodied by semiconductor switching elements. As an amount of data gets larger or the data voltage (Va) is higher, the inverse current more increases depending on a dielectric characteristic of the panel.

SUMMARY OF THE INVENTION

Accordingly, an object of the present invention is to solve at least the problems and disadvantages of the background art.

An object of the present invention is to provide a plasma display apparatus for preventing an inverse current introduced from a panel to a panel driver to reduce a heat dissipation of a data driving integrated circuit, thereby improving a driving reliability.

To achieve these and other advantages and in accordance with the purpose of the present invention, as embodied and broadly described, there is provided a plasma display apparatus including: a data driver for applying a data voltage to a plurality of address electrodes; and a connection unit connected between the address electrode and the data driver, and having a different resistance from the address electrode.

The connection unit has a greater resistance than the address electrode.

The connection unit has at least one resistor.

The resistor is connected to each of the plurality of address electrodes.

The connection unit has a resistance of 100Ω to 10 KΩ.

The connection unit has a resistance of 500Ω to 1.5 KΩ.

In another aspect of the present invention, there is provided a plasma display apparatus including: a data driver for applying a data voltage to a plurality of address electrodes; and an inverse current prevention unit connected between the address electrode and the data driver, and preventing a current from being introduced from a panel capacitor to the data driver, wherein the inverse current prevention unit is formed on a flexible printed circuit board where a driving integrated circuit is mounted.

In a further another aspect of the present invention, there is provided a plasma display apparatus including: a data driver for applying a data voltage to a plurality of address electrodes;

and a plurality of link units for connecting between the data driver and the address electrode, wherein the link unit has a resistance of 100Ω to 10 KΩ.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 5:
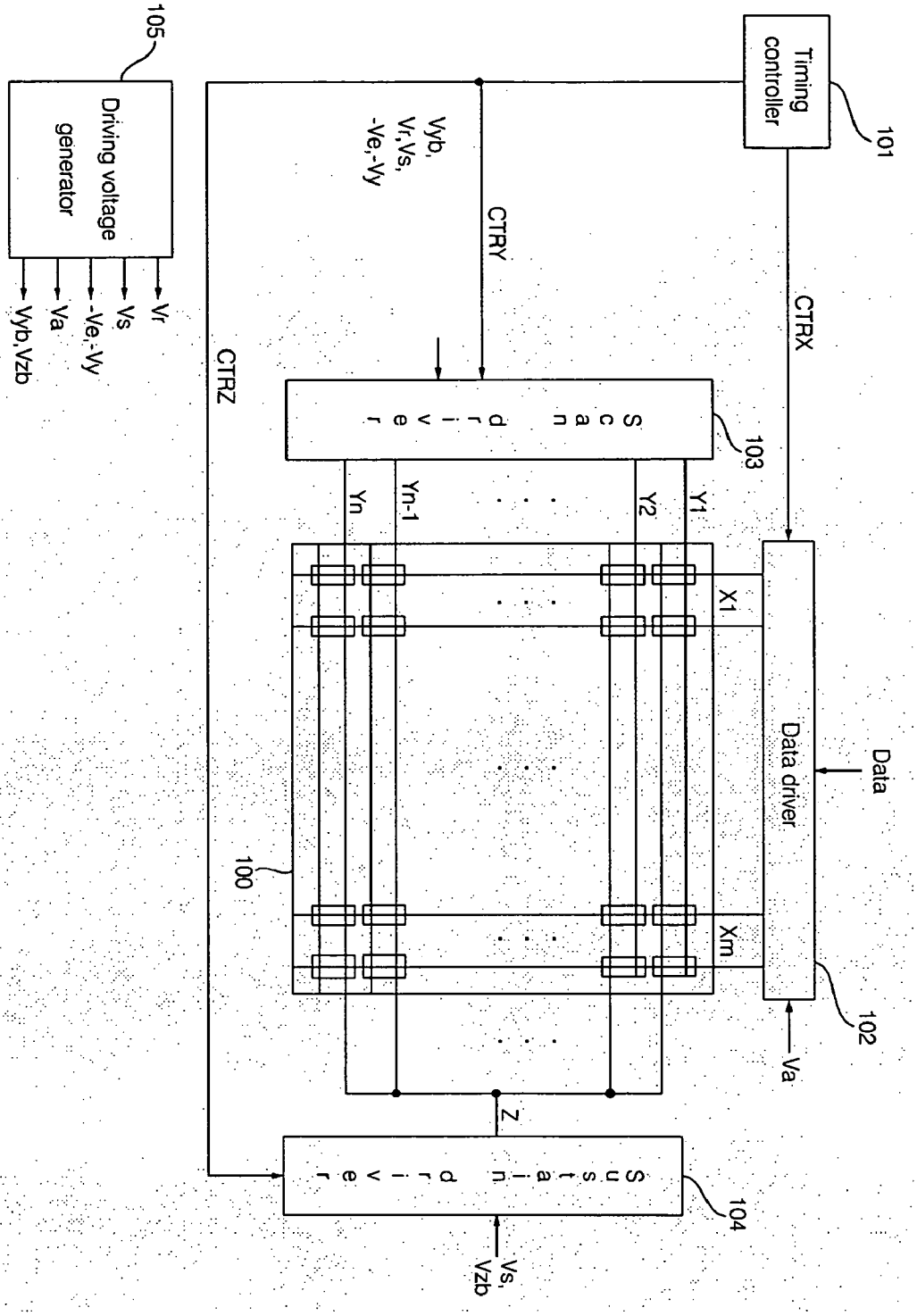
FIG. 5 is a block diagram illustrating a whole construction of a plasma display apparatus according to the present invention.

FIG. 5 is a block diagram illustrating a whole construction of a plasma display apparatus according to the present invention. The plasma display apparatus shown in FIG. 5 will be described with reference to a waveform diagram of FIG. 3.

Referring to FIG. 5, the inventive plasma display apparatus includes a panel 100; a data driver 102 for supplying a data voltage to address electrodes (X1 to Xm); a scan driver 103 for driving scan electrodes (Y1 to Yn) of the panel 100; a sustain driver 104 for driving a sustain electrode (Z) of the panel 100; a timing controller 101 for controlling the respective drivers 102, 103, and 104; and a driving voltage generator 105 for generating a driving voltage necessary for the respective drivers 102, 103, and 104.

The data driver 102 receives data subject to inverse gamma correction and erroneous diffusion by an inverse gamma correction circuit (not shown) and an error diffusion circuit (not shown) and mapped to a subfield pattern previously set by a subfield mapping circuit.

Figure 1:
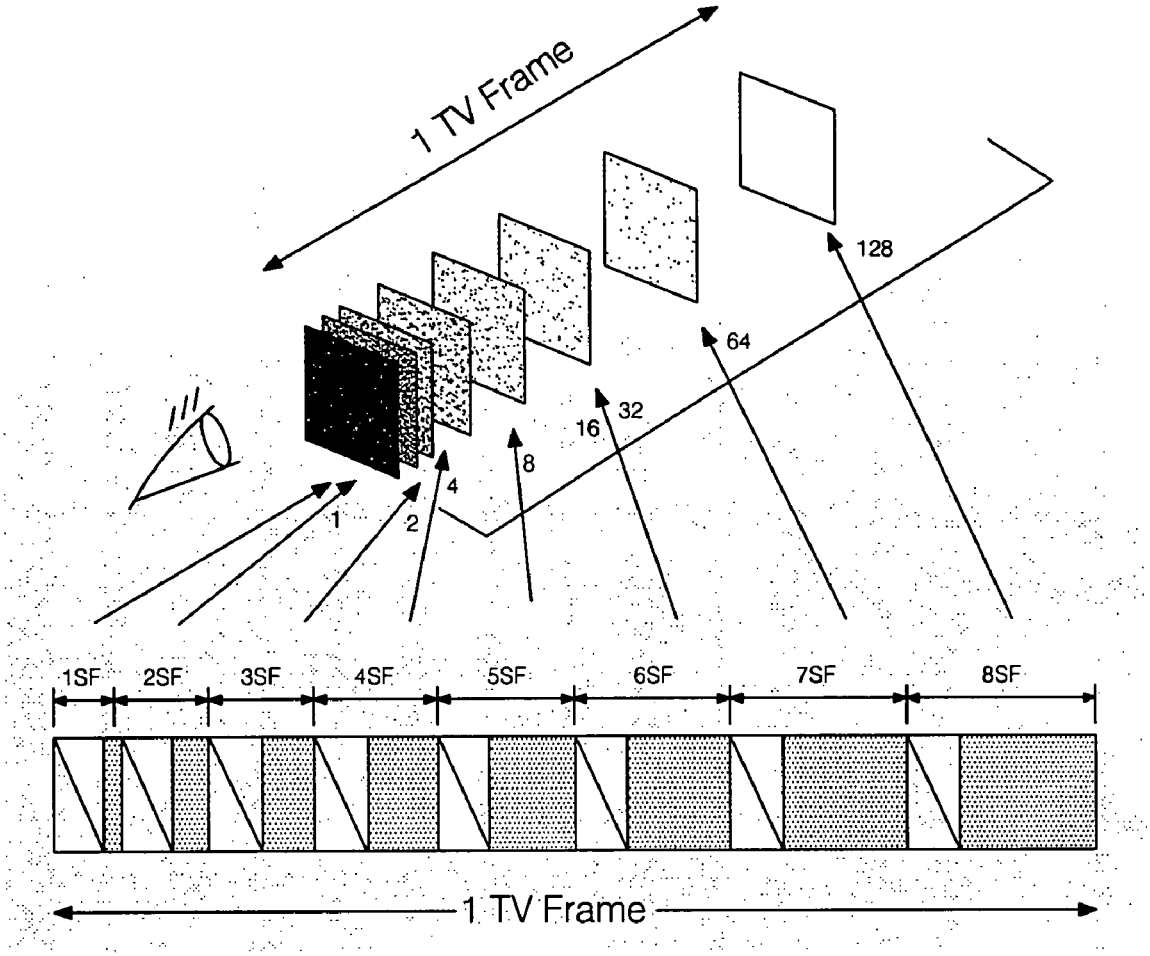
FIG. 1 (Prior Art)
FIG. 1 illustrates a method for expressing a gray level in a plasma display apparatus.
Figure 2:
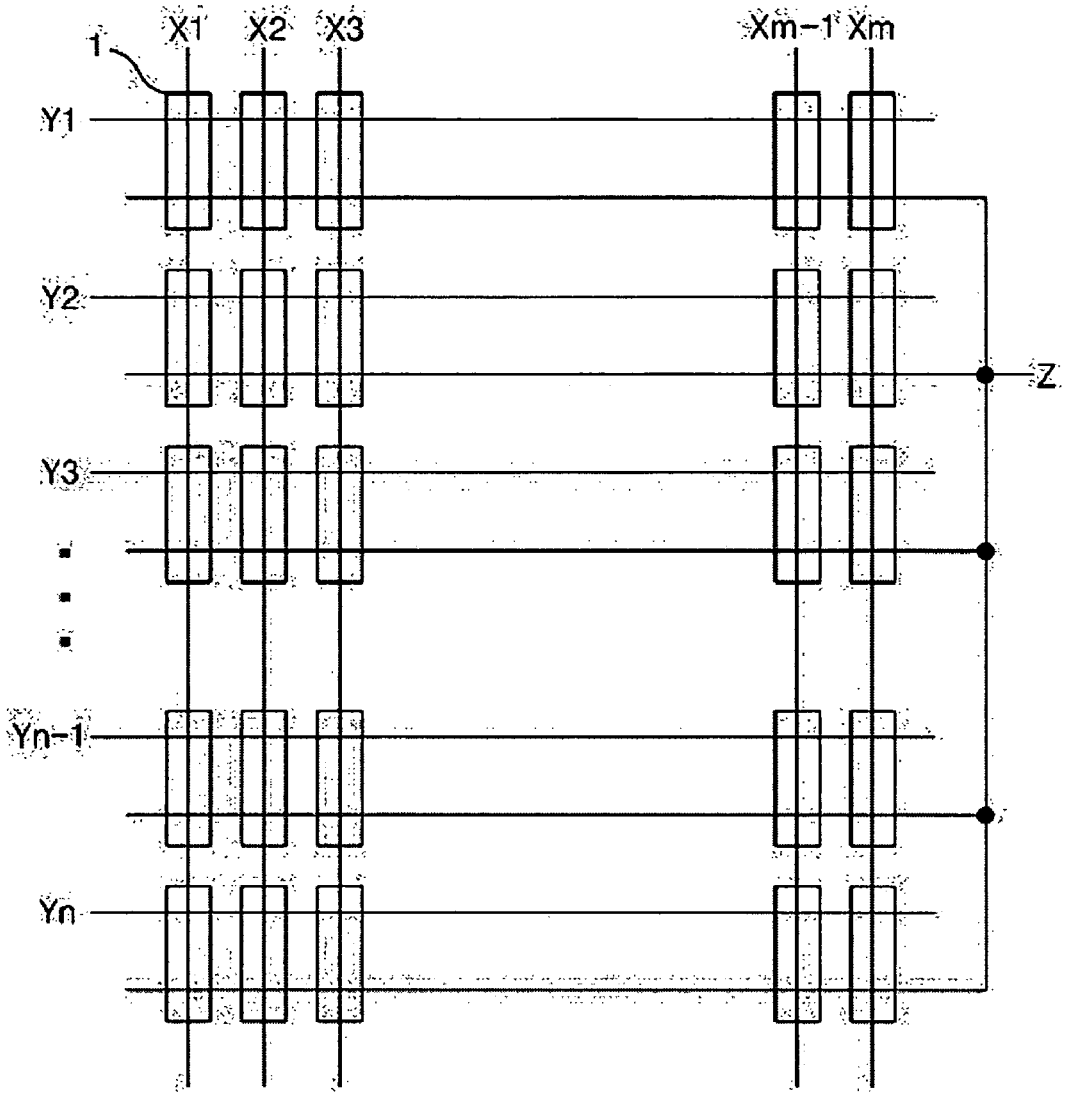
FIG. 2 (Prior Art)
FIG. 2 illustrates an electrode arrangement of a conventional three-electrode alternating current surface discharge type plasma display apparatus.
Figure 3:
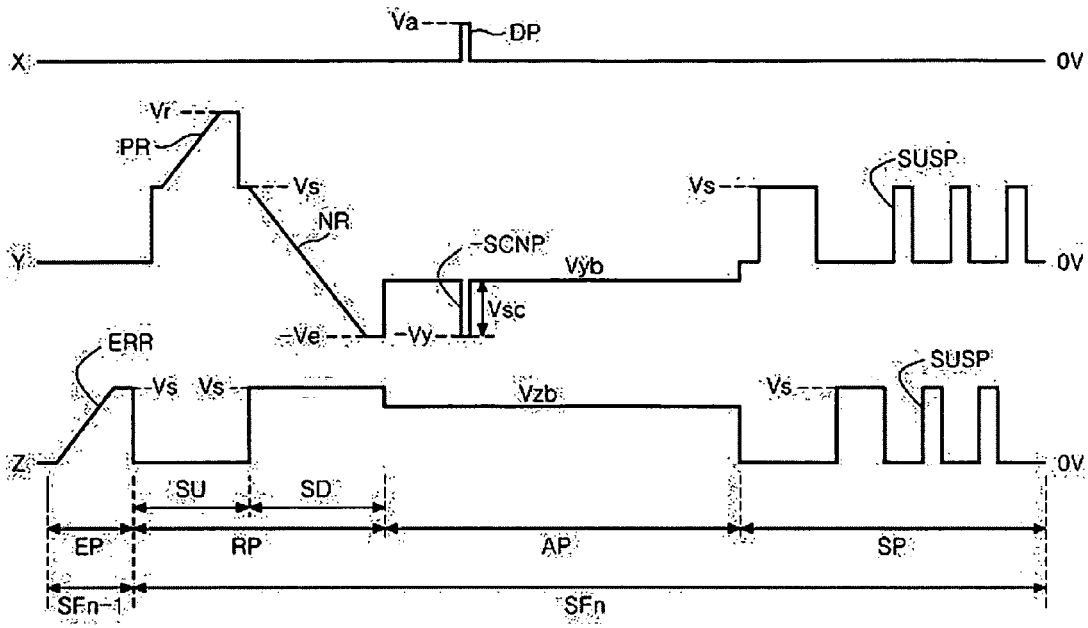
FIG. 3 (Prior Art)
FIG. 3 illustrates a driving waveform of a conventional plasma display apparatus.
Figure 4:
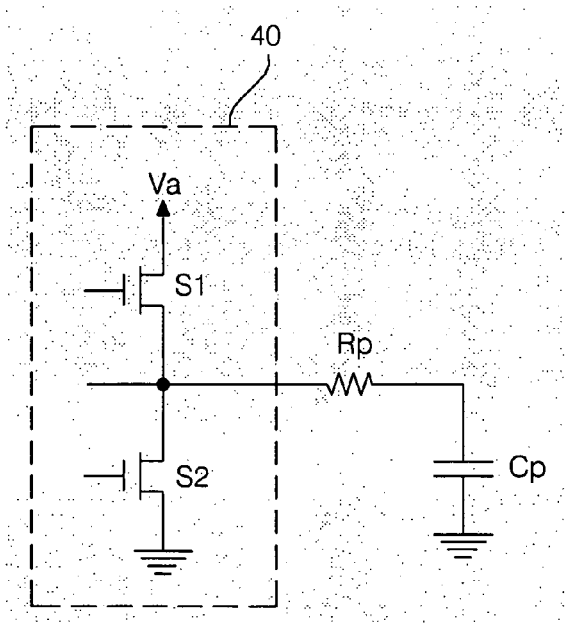
FIG. 4 (Prior Art)
FIG. 4 is an equivalent circuit diagram illustrating conventional data driving integrated circuit and plasma display panel connected thereto.
Figure 6:
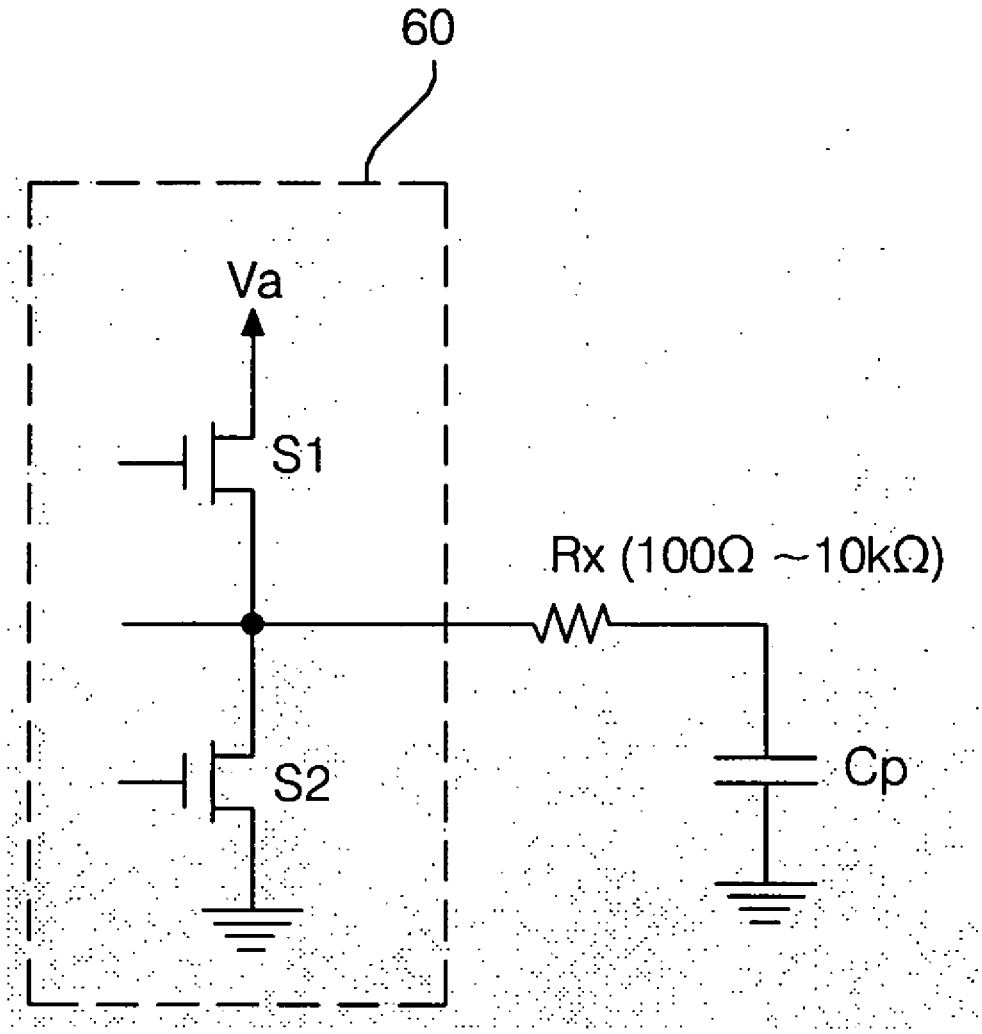
FIG. 6 illustrates a plasma display apparatus according to the first embodiment of the present invention.

The data driver 102 includes a plurality of data driving integrated circuits 60 as shown in FIG. 6, and applies 0V or a base voltage to the address electrodes (X1 to Xm) in a reset period (RP) and a sustain period (SP) as shown in FIG. 3.

The data driver 102 samples and latches data during an address period (AP) of each subfield under the control of the timing controller 201, and then supplies a data voltage (Va) to the address electrodes (X1 to Xm).

The scan driver 103 supplies ramp waveforms (PR and NR) in order to initialize all discharge cells in the reset period (RP) as shown in FIG. 3 under the control of the timing controller 101, and then sequentially supplies a scan pulse (SCNP) to the scan electrodes (Y1 to Yn) in order to select a scan line for supplying data during the address period (AP).

The scan driver 103 supplies a sustain pulse (SUSP) to the scan electrodes (Y1 to Yn) in order to generate a sustain discharge within on-cells selected in the sustain period (SP).

The sustain driver 104 supplies a sustain voltage (Vs) to the sustain electrode (Z) as shown in FIG. 3 during a setdown period (SD) of the reset period (RP) under the control of the controller 101, and then supplies a Z bias voltage (Vzb) lower than the sustain voltage (Vs) in the address period (AP) to the sustain electrode (Z). The sustain driver 104 operates alternately with the scan driver 103 and supplies the sustain pulse (SUSP) to the sustain electrode (Z) in the sustain period (SP).

The timing controller 101 receives a vertical/horizontal sync signal and a clock signal, generates timing control signals (CTRX, CTRY, and CTRZ) necessary for the respective drivers 102, 103, and 104, and supplies the timing control signals (CTRX, CTRY, and CTRZ) to the corresponding drivers 102, 103, and 104, thereby controlling the respective drivers 102, 103, and 104.

The timing control signal (CTRX) supplied to the data driver 102 includes a sampling clock for sampling data, a latch control signal, and a switch control signal for controlling on/off times of an energy recovery circuit and a driving switching element.

The timing control signal (CTRY) applied to the scan driver 103 includes a switch control signal for controlling on/off times of an energy recovery circuit and a driving switching element within the scan driver 103.

The timing control signal (CTRZ) applied to the sustain driver 104 includes a switch control signal for controlling on/off times of an energy recovery circuit and a driving switching element within the sustain driver 104.

The driving voltage generator 105 generates the driving voltages supplied to the panel 100, that is, voltages (Vr, Vs, −Ve, Va, Vyb, and Vzb) of FIG. 3. The driving voltages can be different depending on a discharge characteristic or a composition of a discharge gas that varies according to a resolution and a model of the panel 100.

FIG. 6 illustrates a plasma display apparatus according to the first embodiment of the present invention.

Referring to FIG. 6, the inventive plasma display apparatus includes a connection unit (Rx) formed between the data driver and the address electrode.

The data driver includes a data driving integrated circuit 60. The data driver and the driving integrated circuit 60 generate an address waveform applied to the address electrode by a control signal of the timing controller.

The connection unit (Rx) has a different resistance from the address electrode. In particular, the connection unit (Rx) preferably has a greater resistance than the address electrode.

The connection unit (Rx) can include at least one resistor. The connection unit (Rx) can be comprised of resistors and prevent an inverse current introduced from the panel. The connection unit can be comprised of one resistor, or can be comprised of a plurality of resistors connected to have a specific resistance.

The resistor should be connected to the respective plurality of address electrodes. In other words, the resistor is connected between the respective address electrodes and the data driving integrated circuit 60, and prevents/reduces the current introduced from the respective address electrodes to the data driving integrated circuit 60.

The connection unit (Rx) is comprised of a resistor having a resistance of 100Ω to 10KΩ to cut off an excessive inverse current.

In case where the connection unit (Rx) has a resistance of less than 100Ω, it cannot prevent the current introduced from the panel due to its small resistance. In case where the connection unit (Rx) has a resistance of more than 10KΩ, a current flowing from the data driving integrated circuit 60 to the address electrode is reduced, or a higher voltage is required to apply an optimum current to the address electrode, thereby increasing a power consumption.

In particular, the connection unit (Rx) preferably has a resistance of 500Ω to 1.5KΩ in consideration of a drop of the data voltage and a withstand current characteristic of the data driving integrated circuit. In case where the connection unit (Rx) has the resistance within the range of 500Ω to 1.5Ω, it can effectively prevent the inverse current introduced from the panel to the data driving integrated circuit 60, and can also maintain a consumption power consumed by the connection unit (Rx) not to be greater than in a conventional art.

A panel capacitor (Cp) has a parasitic capacitance between the address electrode and the scan electrode and a parasitic capacitance between the address electrode and the sustain electrode, that is, has a total capacitance of the panel.

Figure 7:
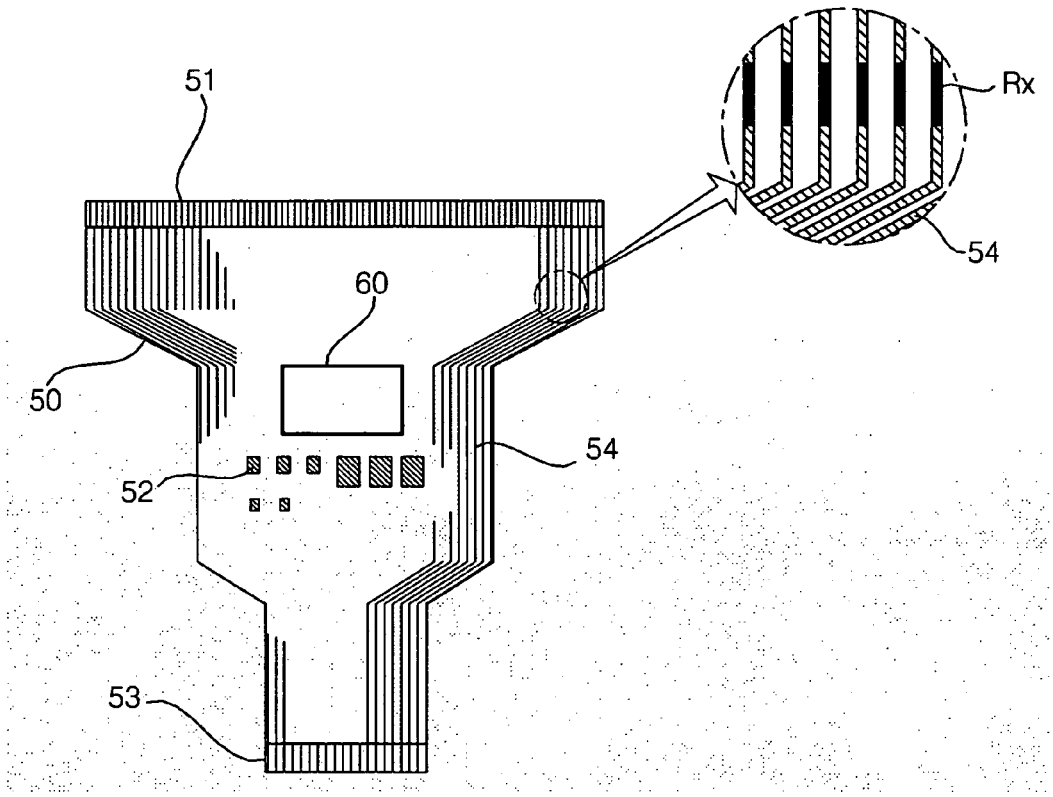
FIG. 7 illustrates a structure of a chip on film (COF) according to the second embodiment of the present invention.
Figure 8:
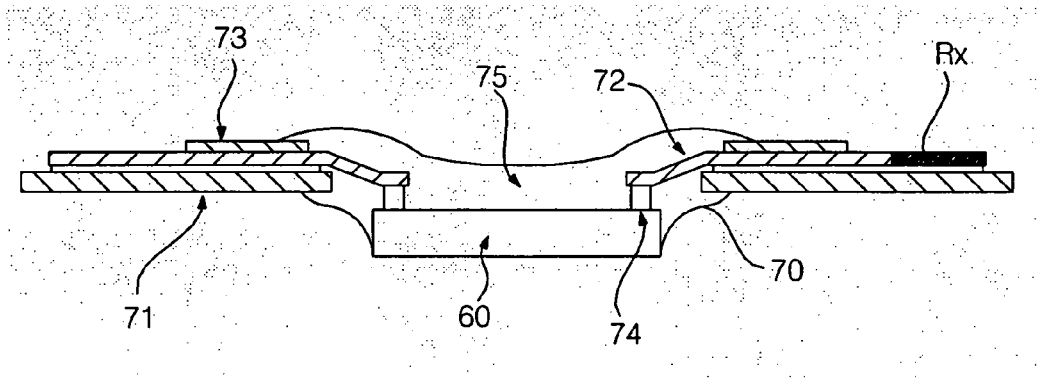
FIG. 8 illustrates a structure of a tape carrier package (TCP) according to the second embodiment of the present invention.

Referring to FIGS. 7 and 8, the plasma display apparatus according to the second embodiment of the present invention includes a data driver for applying a data voltage to a plurality of address electrodes; and an inverse current prevention unit (Rx) connected between the address electrode and the data driver and preventing introduction of a current to the data driver. It is characterized in that the inverse current prevention unit (Rx) is formed on a flexible printed circuit board (FPCB) on which a data driving integrated circuit 60 is mounted.

The data driver includes the data driving integrated circuit 60. The data driver and the driving integrated circuit 60 generate an address waveform applied to the address electrode by a control signal of a timing controller.

The inverse current prevention unit (Rx) has the same construction and operation as the connection unit described in the first embodiment of the present invention. However, it is characterized in that the inverse current prevention unit is formed on the flexible printed circuit board (FPCB).

The second embodiment of the present invention is embodied in a chip on film (COP) form or in a tape carrier package (TCP) form.

FIG. 7 illustrates a structure of the chip on film (COF) according to the second embodiment of the present invention. Referring to FIG. 7, the COF 50 is constructed to have a plurality of passive elements (resistor and capacitor) 52 and the data driving integrated circuit 60 mounted on the flexible printed circuit board (FPCB).

The flexible printed circuit board (FPCB) includes a synthetic resin film; an electrode connection pad 51 formed at one end of the film and connected with the address electrode; a board connector 53 formed at the other end of the film and connected with the address driving circuit; and a copper wire 54 formed on the film.

The inverse current prevention unit (Rx) is formed at one end of the copper wire 54 as shown in a magnified portion of FIG. 7.

The inverse current prevention unit (Rx) preferably has a greater resistance than the address electrode.

The inverse current prevention unit (Rx) can include at least one resistor. The inverse current prevention unit (Rx) is comprised of the resistors, and can prevent the inverse current introduced from the panel. The inverse current prevention unit (Rx) can be comprised of one resistor, or can be comprised of a plurality of resistors connected to have a specific resistance.

The resistor is connected to each of the plurality of address electrodes. In other words, the resistor is connected between the respective address electrodes and the data driving integrated circuit 60, and prevents/reduces the current introduced from the respective address electrodes to the data driving integrated circuit 60.

The inverse current prevention unit (Rx) is comprised of a resistor having a resistance of 100Ω to 10KΩ to cut off an excessive inverse current.

In case where the inverse current prevention unit (Rx) has a resistance of less than 100Ω, it cannot prevent the current introduced from the panel due to its small resistance. In case where the inverse current prevention unit (Rx) has a resistance of more than 10KΩ, a current flowing from the data driving integrated circuit 60 to the address electrode is reduced, or a higher voltage is required to apply an optimum current to the address electrode, thereby increasing a power consumption.

In particular, the inverse current prevention unit (Rx) preferably has a resistance of 500Ω to 1.5KΩ in consideration of a drop of the data voltage and a withstand current characteristic of the data driving integrated circuit. In case where the inverse current prevention unit (Rx) has the resistance within the range of 500Ω to 1.5KΩ, it can effectively prevent the inverse current introduced from the panel to the data driving integrated circuit 60, and can also maintain a consumption power consumed by the inverse current prevention unit (Rx) not to be greater than in a conventional art.

FIG. 8 illustrates a structure of a tape carrier package (TCP) according to the second embodiment of the present invention. Referring to FIG. 8, the TCP 70 also includes a data driving integrated circuit 60 mounted on a flexible printed circuit board.

The flexible printed circuit board includes a synthetic resin base film 71; and a copper wire 72 formed on the base film 71 and serving as a transfer path of a signal in the address electrode or the address driving circuit.

The TCP 70 includes a solder resist 73 for preventing scratching of the copper wire 72; a bump 74 for fixing/connecting a pin portion of the copper wire 72 and the data driving integrated circuit 60; and a sealing resin for sealing the data driving integrated circuit 60 and bump 74 portion.

The inverse current prevention unit (Rx) is formed at one end of the copper wire 72 as shown in FIG. 8.

In a similar manner, the inverse current prevention unit (Rx) substantially has the same construction and operation as the connection unit or the inverse current prevention unit (Rx) formed on the COF according to the first embodiment of the present invention.

Figure 9:
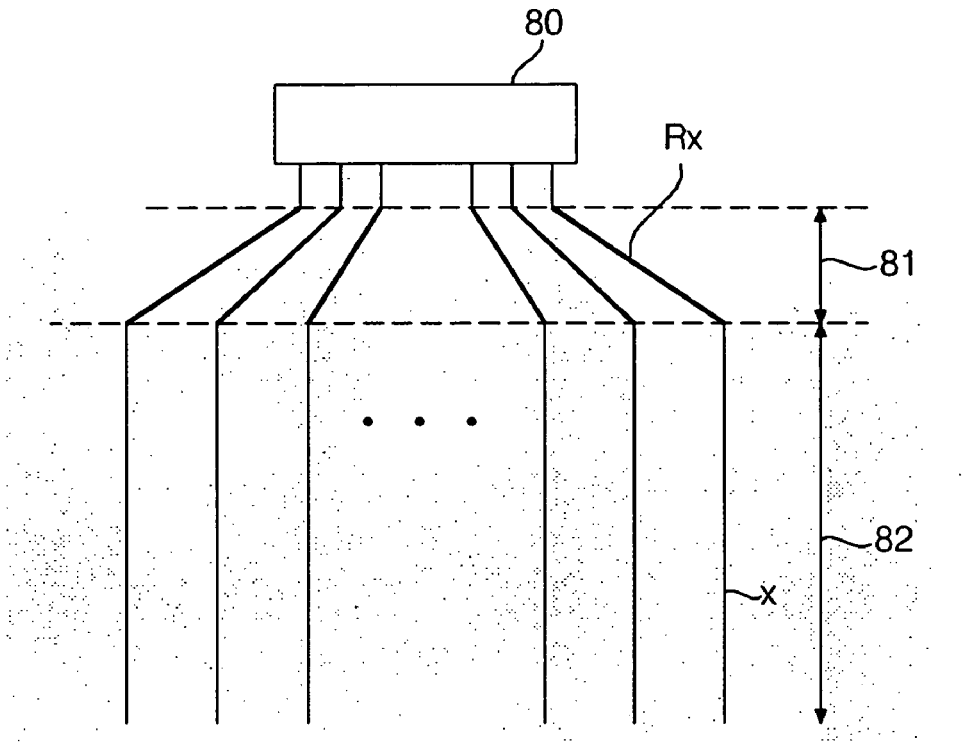
FIG. 9 illustrates a plasma display apparatus according to the third embodiment of the present invention.
Figure 10:
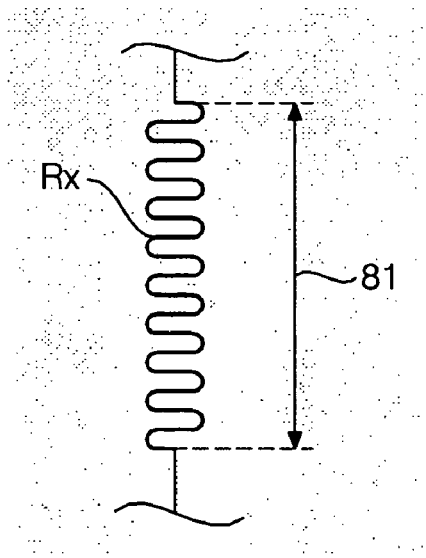
FIG. 10 illustrates a varied form of a link unit according to the third embodiment of the present invention.

FIG. 9 illustrates a plasma display apparatus according to the third embodiment of the present invention.

Referring to FIG. 9, the inventive plasma display apparatus includes a data driver 80 for applying a data voltage to a plurality of address electrodes; and a plurality of link units (Rx) for connecting the data driver 80 and the address electrode (X). It is characterized in that the link unit (Rx) has a resistance of 100Ω to 10 KΩ.

As shown in FIG. 9, the address electrode (X) denotes an address electrode wire portion 82 positioned at an effective screen of a panel, and the link unit (Rx) denotes a wire of a portion 81 connecting from an output terminal of the data driver 80 to the address electrode (X) of the effective screen in order to compensate for a pitch between the data driver 80 and the address electrode (X).

The address electrode (X) has a rather low resistance of about 20Ω due to its main component of silver (Ag) and therefore, can have an inverse current introduced from the panel.

In order to prevent this, in the plasma display apparatus according to the third embodiment, the link unit (Rx) being a wire connecting between the address electrode (X) and the data driver 80 has the resistance of 100Ω to 10 KΩ, thereby cutting off the current inversely introduced from the address electrode (X).

The link unit (Rx) preferably has a resistance of 500Ω to 1.5 KΩ.

A reason why the resistance of the link unit (Rx) is set as above is substantially the same as those of the first and second embodiments.

In order to have a higher resistance than the address electrode (X), the link unit (Rx) has a lower content of silver (Ag) and is formed of a metal material having a relatively high specific resistance.

In order not to be bent like a zigzag pattern of FIG. 8, the wire can be also patterned, and be lengthened in length, thereby increasing the resistance of the link unit (Rx).

In another application example, the link unit (Rx) is reduced in thickness to be less than the address electrode, thereby increasing the resistance of the link unit (Rx).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a data driver for applying a data voltage to a plurality of address electrodes; and a plurality of link units for connecting between the data driver and the address electrode, wherein the link unit has a resistance of 100Ω to 10 KΩ, and the link unit has a resistance different from the address electrode, wherein the link unit is formed in a bent form, and wherein the link unit has a thickness less than a thickness of the address electrode.

2. The apparatus of claim 1, wherein the link unit includes a metal material having a high specific resistance.

3. The apparatus of claim 1, wherein the link unit has a resistance of 500Ω to 1.5 KΩ.

* * * * *